United States Patent [19]

Windish

[11] Patent Number: 4,463,510

[45] Date of Patent: Aug. 7, 1984

[54] SPACE SAVING VARIABLE LENGTH TAG DISPLAY DEVICE

[76] Inventor: Richard J. Windish, 10 Whitehall Dr. R.D. #1, Chadds Ford, Pa. 19317

[21] Appl. No.: 516,769

[22] Filed: Jul. 25, 1983

Related U.S. Application Data

[63] Continuation of Ser. No. 233,625, Feb. 12, 1981, abandoned.

[51] Int. Cl.[3] ..... B65D 73/00; A47F 7/00

[52] U.S. Cl. ..... 40/124.4; 40/19.5; 40/2 R; 211/54.1; 211/57.1; 211/59.1; 248/220.4; 248/300; 206/459

[58] Field of Search ..... 40/2 R, 10 R, 20 A, 40/19.5, 124.4; 211/54.1, 57.1, 59.1; 248/220.3, 220.4, 221.1, 221.2, 300; 206/459; 229/16 D

[56] References Cited

U.S. PATENT DOCUMENTS

| | | | |
|---|---|---|---|
| 2,469,210 | 5/1949 | Schwab | 40/124.4 |
| 2,638,643 | 5/1953 | Olson | 248/300 |
| 3,531,879 | 10/1970 | Bogese | 40/124.4 |
| 3,645,485 | 2/1972 | Gold | 248/223 |
| 3,799,357 | 3/1974 | Govang | 206/459 |
| 3,976,201 | 8/1976 | Hodgson et al. | 248/220.4 |
| 3,977,109 | 8/1976 | Berry, Jr. et al. | 40/16 |
| 4,246,710 | 1/1981 | Mixer | 40/16.4 |
| 4,303,217 | 12/1981 | Garfinkle | 248/221.1 |
| 4,366,906 | 1/1983 | Joyce | 211/59.1 |

FOREIGN PATENT DOCUMENTS

| | | | |
|---|---|---|---|
| 2447032 | 4/1976 | Fed. Rep. of Germany | 211/54.1 |
| 2055555 | 3/1981 | United Kingdom | 248/220.3 |

*Primary Examiner*—Gene Mancene
*Assistant Examiner*—David L. Tarnoff
*Attorney, Agent, or Firm*—Woodcock, Washburn, Kurtz, Mackiewicz & Norris

[57] ABSTRACT

This invention relates to variable length tag display devices formed from a unitary piece of sheet material and suitable for use with hook means used for displaying merchandise in retail outlets such as grocery stores and drug stores. The tag display devices of this invention comprise a tag portion, a variable length spine portion, a back portion and means for attachment to a display base. The structures of this invention are useful with a wide variety of hook means and hook lengths. These tag display devices enable retailers to display product information such as item price, unit cost and inventory information without substantial reduction of space on a display base.

5 Claims, 7 Drawing Figures

SPACE SAVING VARIABLE LENGTH TAG DISPLAY DEVICE

This is a continuation of application Ser. No. 233,625, filed 02/12/81, now abandoned.

BACKGROUND OF THE INVENTION

This invention relates to a tag display device for identifying items positioned on hook means so that information, including item description, inventory codes and selling prices, may be located at the front of the hook holding the merchandise for sale, and without substantial reduction in space on a display base.

A variety of methods are used to display products stocked in retail outlets such as department stores, hardware stores, grocery stores or drug stores. These methods include placing items on shelves, in refrigerated cases, or suspending them from hooks. Displaying merchandise by hooks, such as on a peg board, is a much used technique. Some of the advantages of this method of display are that it provides: (a) an effective utilization of space, since a larger variety of products may be displayed on a peg board as compared to shelving; (b) an easier system for stocking and removing merchandise; and (c) a convenient way of displaying odd-shaped articles. Displaying merchandise by hooks also reduces the amount of stock required to make an attractive display and requires less capital outlay for fixtures used to attract customers.

Providing easily readable tags for items displayed on shelves is important in giving the consumer price information, e.g., item price and price per unit, as well as allowing store personnel to keep accurate inventory records. A number of different tag designs have been developed to provide pricing information to the consumer and aid in stock control for store personnel. Many of these tag designs or labels require a channel structure to serve as the base support, as may be seen in U.S. Pat. Nos. 4,140,224; 3,977,109; 3,706,150; and 2,850,820. Channel base structures have also been used for labeling items displayed by hook means, e.g., by hooks inserted into peg boards. For examples of these devices see U.S. Pat. Nos. 4,236,336; 3,707,049; and 3,531,879. The problem with using these channel structures for items displayed on hooks is that the needed information is displayed in close proximity to the display base. Thus, if the hook holding the merchandise is of greater than minimal length, the hook is holding a large quantity of merchandise, or other hooks with merchandise are in close proximity to the particular hook in question, it is difficult to see what information is contained in these channel display structures. As more stores rely on machine readable pricing codes such as the Universal Product Code and discontinue marking prices on individual items, the need for clear visual displays of price information for merchandise displayed by hooks becomes extremely important. For store personnel using devices such as pen scanners to read inventory information, it is important to have easy access to the information contained on the item labels used for merchandise displays such as the types of merchandise displayed by attaching the items to card structures and as frequently found in grocery stores or drug stores.

Previous attempts to make tags suitable for use with items displayed by hook means have produced tag displays that reduce the amount of usable space on a display board, and are expensive, e.g. made from metal, hard to read, and of fixed length.

Thus, it is an object of this invention to provide a tag display device suitable for use with items displayed by hooks that does not appreciably reduce the amount of usable space on a display board.

It is another object of this invention to provide a tag display structure that is inexpensive to fabricate and easy to produce.

It is a further object of this invention to provide a variable length tag display structure that displays information at the front of the items displayed by suspending such items from a hook.

BRIEF SUMMARY OF THE INVENTION

The present invention provides variable length tag display devices or structures formed from a unitary piece of sheet material and suitable for use with hook means used to display merchandise, without appreciably increasing the amount of space needed to display the merchandise. The various embodiments of this invention each comprise a tag portion which allows information to be displayed in a convenient and easily readable manner at the front portion of the hook without interfering with a customer's ability to remove an individual item of merchandise from the hook; a variable length spine portion which may be adapted to a variety of hook lengths; a back portion which is formed by bending a section of the spine portion, e.g. in a downward direction, so as to be in substantial contact with a display base at a point of attachment; and means for attaching the tag display device to a display base such as by adhesive material applied to the back portion or perforated holes spaced to allow a peg hook to hold the back portion in contact with a display base when the peg hook is inserted into a perforated display base, e.g. pegboard. The tag portion of the tag display device is folded and positioned at a preselected angle to allow the information on the tag portion to be easily read. The angle is selected according to the position of the merchandise display and in relation to the field of vision of the viewer.

While the tag display devices of this invention may be used with a variety of hook means, those hook means having a generally elongated structure, i.e. having a front end portion which extends a distance outward from a display base, are particularly well suited for use with this invention.

DETAILED DESCRIPTION OF THE EMBODIMENTS

Figure 1:
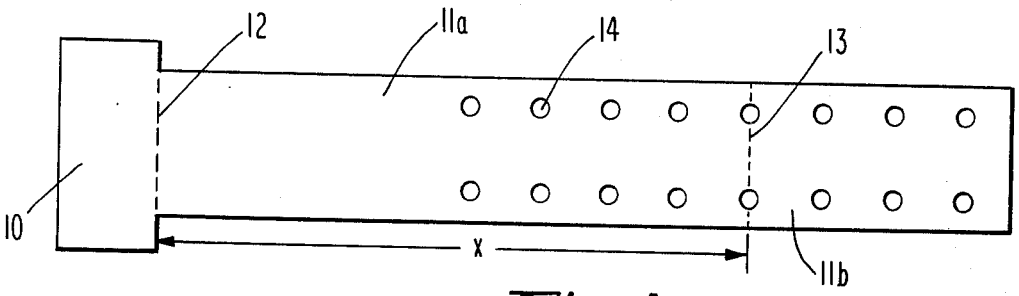
FIG. 1 is a plan view of a first embodiment of the invention as cut from a sheet of flat stock.

FIG. 1 shows a plan view of a first embodiment of the tag display structure of the invention after it has been cut from sheet material. The display structure may be fabricated from a variety of materials, for example card board, heavy paper stock or various types of plastics. It is important that the material selected be bendable without breaking, yet have sufficient body so as to hold its shape after forming. It has been found that polycarbonate materials are particularly suitable, such as Tuffak® from Rohm & Haas. The display tag structure is comprised of a tag portion 10 which may have information printed on it or serve as a base for a separately attached tag such as an adhesive label applied on the tag portion 10. A spine portion 11*a* extends from the tag portion 10 and is preferably narrower than the tag 10 for ease in folding along a fold line 12. A back portion 11*b* is formed from spine 11*a* by selecting a distance x to correspond to the length of a hook to be tagged (i.e. a hook from which merchandise to be labeled will be suspended), and folding spine 11*a* along a fold line 13 to form a back section 11*b* bent away from the plane of the spine 11*a* of the tag structure. In this first embodiment sections of the spine 11*a* and back 11*b* have holes 14 perforated therethrough at preselected intervals to correspond to the spacing of holes on a perforated display base such as a peg board. For ease in folding it is also preferred that fold line 13 bisect holes 14, to form back portion 11*b*.

Figure 2:
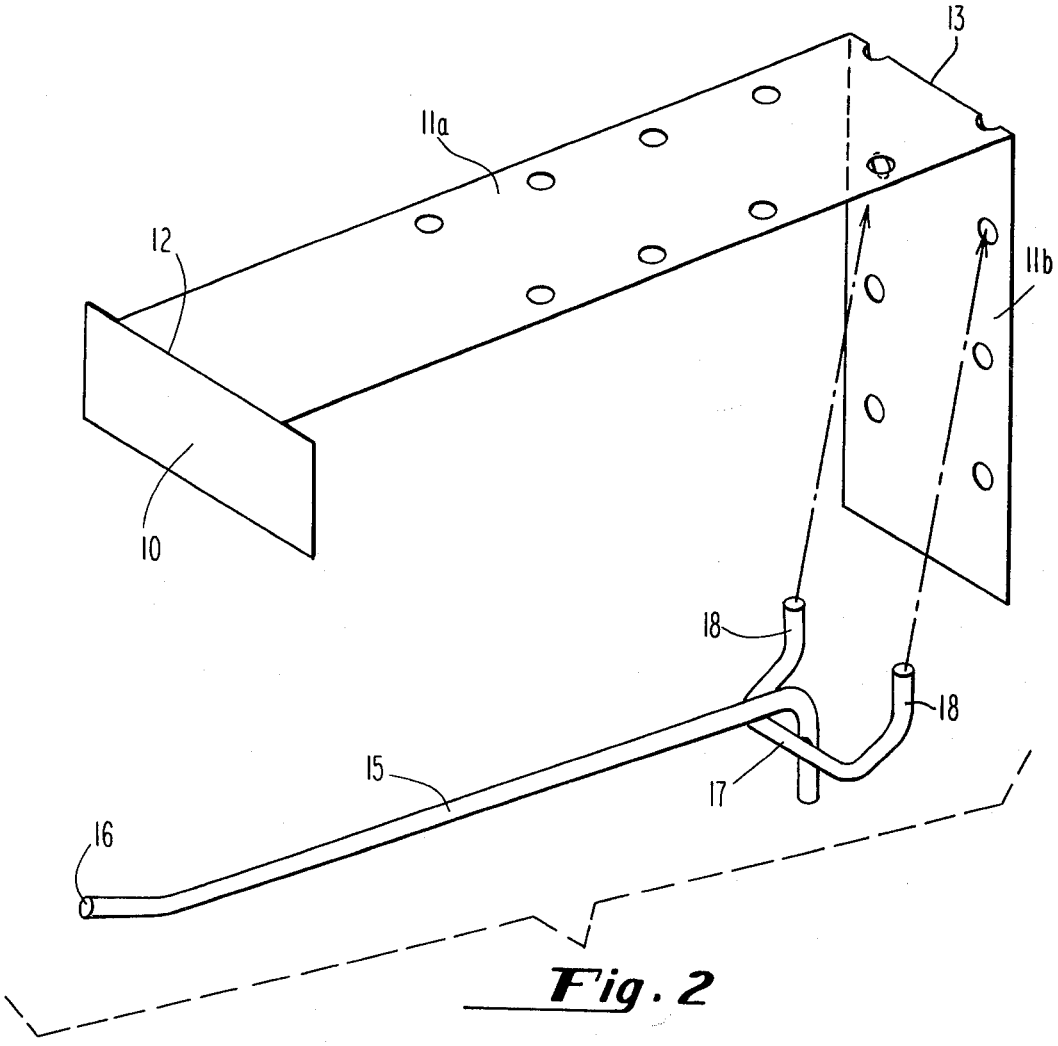
FIG. 2 is an exploded perspective view of the first embodiment as folded into position for use with a hook in a display.

FIG. 2 is an exploded perspective view of the embodiment shown in FIG. 1 as folded into position for use with a hook in a display. Tag 10 is shown folded along line 12 in a downward direction in relation to spine 11*a*. Back portion 11*b* is formed in this embodiment by folding a section of spine 11*a* along line 13 in a downward direction in relation to spine 11*a*. A hook 15 is shown with an upturned end 16 and attached to a bar member 17 having prongs 18 which also serve as locking members.

Figure 3:
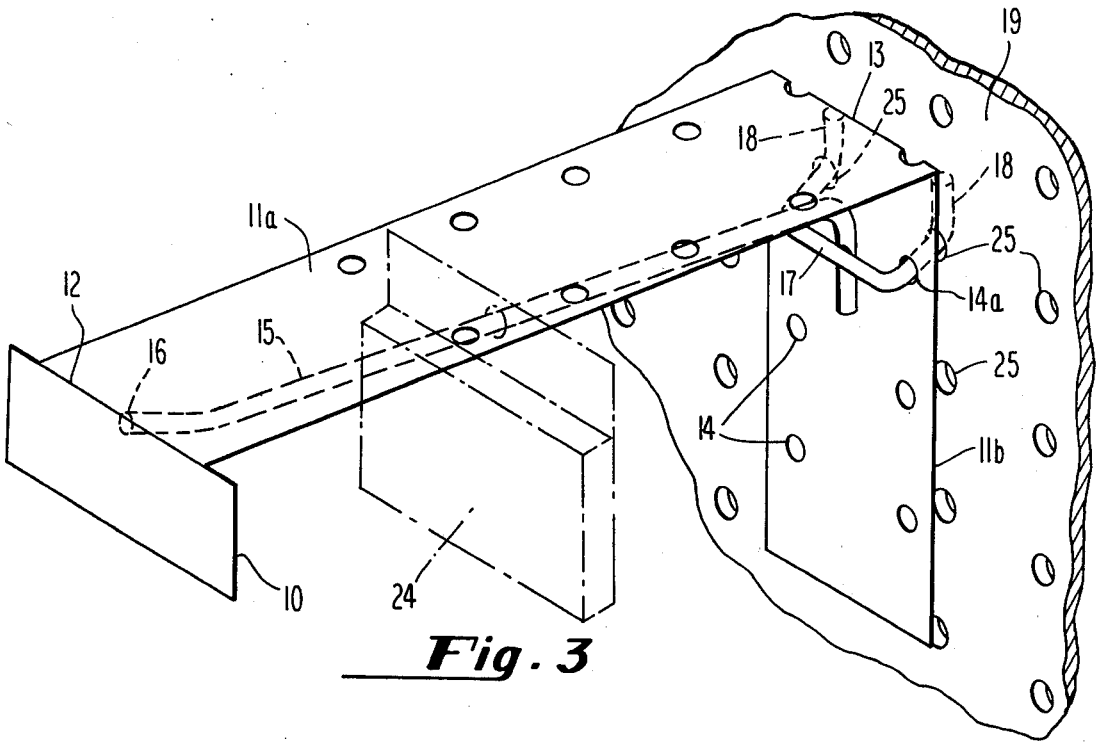
FIG. 3 is a view of the first embodiment as positioned on a peg board with a hook.

FIG. 3 shows the same perspective view as in FIG. 2 of the inventive tag display structure as positioned on a hook 15, with goods 24 shown in phantom suspended from the hook 15. The tag portion 10 would typically carry information relating to the goods, such as price, weight, inventory codes and the like. The front of the spine 11*a* is juxtaposed to and rests on an upturned portion 16 of hook 15 preferably in close proximity to fold line 12. The embodiment shown in FIG. 3 is suitable for use with a hook 15 attached to a bifurcated member comprising a bar 17 and prongs 18 which serve also as locking members. In this embodiment a series of pairs of holes 14 have been spaced to cooperate with prongs 18 and perforations 25 in a display base 19. Thus, the tag display device may be attached to display base 19, such as a peg board, by inserting prongs 18 through attachment holes 14*a* to hold back portion 11*b* in contact with display board 19 by prongs 18 which also serve as locking members.

Figure 4:
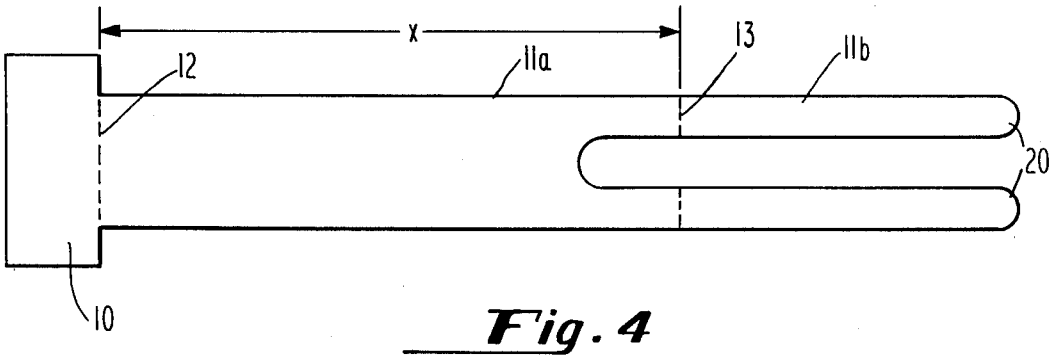
FIG. 4 is a plan view of a second embodiment of the invention as cut from a sheet of flat stock.

FIG. 4 is a plan view of an alternate embodiment of the invention with a tag 10 foldably connected to spine 11*a* along line 12. Length x is selected to correspond to the length of a hook means and back portion 11*b* is formed by folding spine 11*a* along fold line 13. The tag display device in this embodiment has been fabricated to include bifurcated leg members 20 which as shown may form the entire back portion 11*b* and at least a partial section of spine 11*a*.

Figure 5:
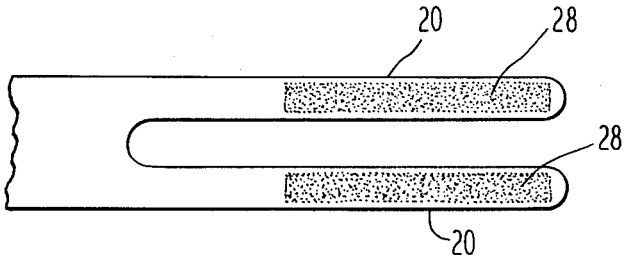
FIG. 5 is a cutaway section of FIG. 4 showing optional adhesive strips on the second embodiment.

FIG. 5 is a cutaway section of the second embodiment showing adhesive strips 28 positioned on at least a portion of leg members 20 as a means of attaching the second embodiment to a display structure.

Figure 6:
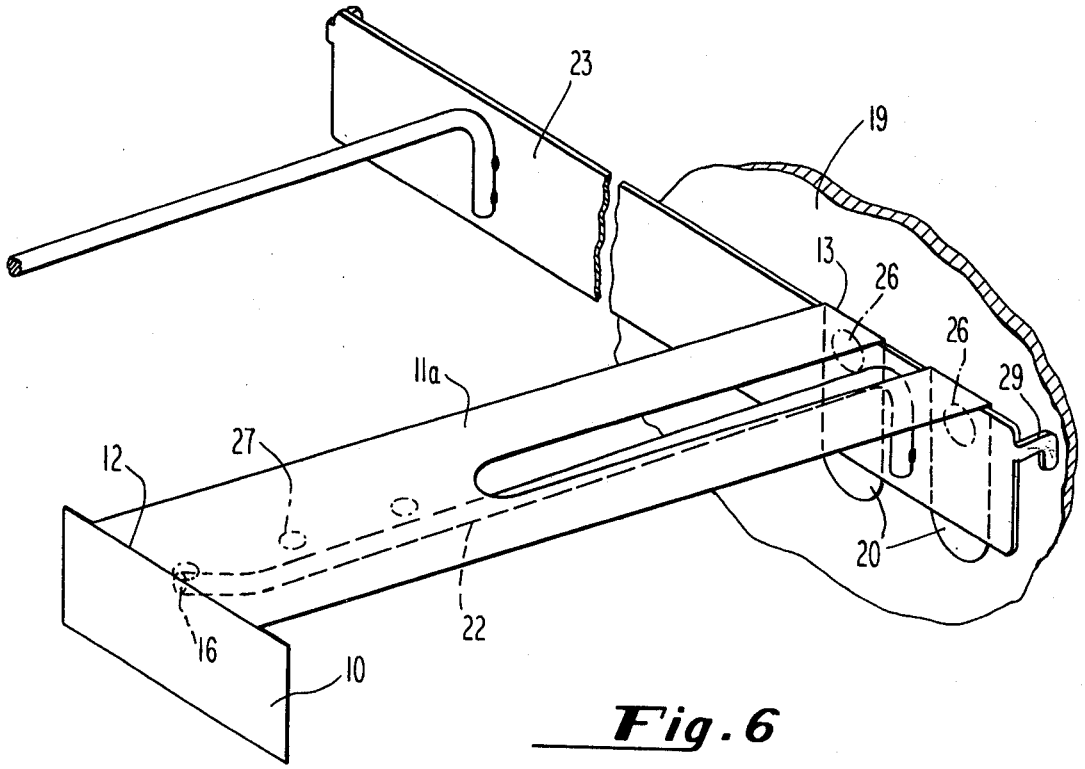
FIG. 6 is a perspective view of the second embodiment as positioned on a single hook display having a back plate.

FIG. 6 is a perspective view of the embodiment in FIG. 4 as installed over the body of a single hook 22 by attaching means such as adhesive strips (shown in FIG. 5) or fastener means such as tacks 26 (shown in phantom) positioned on leg members 20 and selected to hold the members in contact with display base 19. Alternatively, banks of display hooks, e.g. as those used to display shoelaces, are fabricated, by welding a number of metallic hooks to a metallic back plate 23 to form a bank of hooks (indicated as a cutaway section). This bank of hooks is then affixed to a display base 19 by attachment means 29 positioned at selected intervals along the back plate 23. If a back plate is used, leg members 20 may be attached to the front or back of this back plate 23 by attaching means such as adhesive, with the back plate 23 then being mounted on a display base 19. This bank of hooks may have only a few points of attachment to a display base. Thus, while the embodiment shown in FIGS. 1–3 may not be conveniently utilized to label hooks affixed to the bank structure having a back plate 23, the embodiment shown in FIGS. 4–7 may be used to label hooks affixed to such a bank structure. Optionally a series of slits or retaining holes 27 (shown in phantom) may be positioned at preselected intervals in this embodiment (or the embodiment shown in FIGS. 1–3), on or about the midline of spine 11*a*, so that in display position a front portion of spine 11*a* may be held in a stabilized position by partial cooperation of the upturned portion 16 of a hook 22 into the retaining hole 27. The tag display structure is lifted up and off the retaining hole 27 as merchandise is removed by the customer and the structure then falls back into position as the tag display structure moves downward to resume its rest position.

Figure 7:
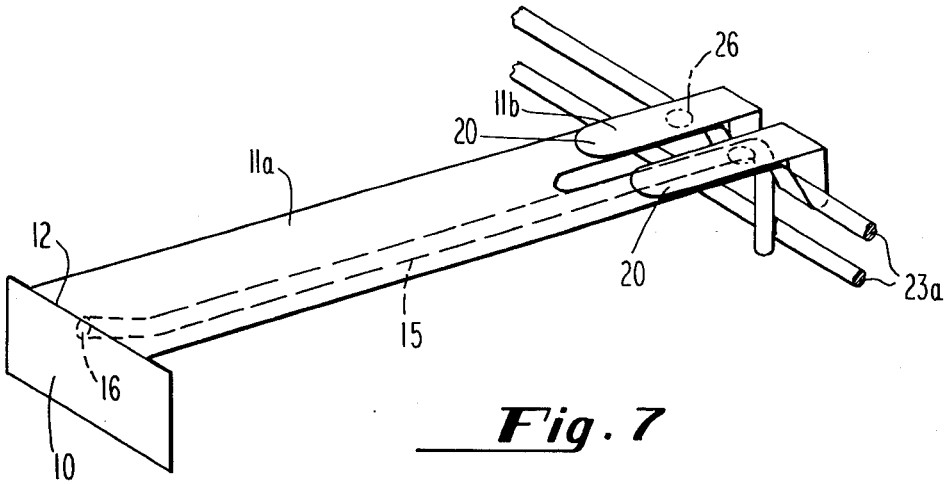
FIG. 7 is a perspective view of the second embodiment as positioned on a single hook display having a base comprised of two bars or wire rods.

FIG. 7 shows the second embodiment as positioned on a hook 15 so that members 20 may wrap around at least one of bars 23*a* and be fixed into position by adhesive (not shown) or tacks 26 (shown in phantom). One may also use this wrap technique for attaching the tag display structure shown in this embodiment to a bank of hooks formed by spot welding a series of hooks to a solid base structure, e.g. the type shown in FIG. 6.

One must keep in mind that the tag display structures of this invention are useful with a variety of hook means and hook lengths. For example, the embodiment shown in FIGS. 1–3 may be used with hooks having a plurality of prongs as attachment means, such as by fabricating display devices that have wider spines and backs and which contain enough holes at preselected positions to accommodate more than two prongs. Likewise the embodiment shown in FIGS. 4–7 may be fabricated in multiple units so that a horizontal bank of hooks attached to a back plate or spot welded to a wire bar structure (e.g. a series of hooks welded to two or more wire bars constructed parallel to each other), may be labeled in groups of two or more. Other variations include but are not limited to use of tag portions and/or temporary tag labels of various sizes and colorations affixed to the tag portion of the display tag, and temporary sale tags fabricated from a disposable material such as paper for temporary positioning over the tag display structure.

While a variety of embodiments have been described, it is to be understood that various other alternative embodiments may be found that are within the spirit and scope of this invention.

I claim:

1. A system for displaying merchandise comprising:

a perforated display base;

generally elongated hook means having an end insertable into said display base;

a display device formed from a unitary piece of sheet material and comprising:

a tag portion;

an elongated variable length spine portion with pairs of holes disposed at predetermined intervals along its length, said tag portion being foldably connected to one end of said spine portion;

a back portion foldably connected to the other end of said spine portion, said pairs of holes of said spine portion continuing at predetermined intervals along the length of said back portion; and means for attaching said back portion to said display base wherein said device is attached to said display base by passing said hook attaching means through a pair of said holes in said base portion and through a pair of corresponding perforations in said display base, wherein said spine portion is variable in length by being bent across a remaining pair of said holes so as to form said back portion and said spine portion at its selected length and said tag portion is substantially juxtaposed to the end of said hook means not attached to said base.

2. A display device for labelling items displayed on a generally elongated hook means having means for attaching one end of the hook means to a perforated display base, said display device formed from a unitary piece of sheet material and comprising:

an elongated variable length spine portion, said spine portion having a tag portion foldably connected to one end of said spine portion and a back portion foldably connected to the other end of said spine portion, said spine portion having pairs of holes disposed at predetermined intervals along its length and said pairs of holes continued at predetermined intervals along the length of said back portion;

wherein said device is attached to said display base by passing said hook attaching means through one of said pairs of holes in said base portion and through a pair of corresponding perforations in said display base; and wherein said spine portion is variable in length by bending said spine portion across a remaining pair of holes so as to form said back portion and so that said tag portion is substantially juxtaposed to the end of said hook means not attached to said display base.

3. A display device as in claim 2 wherein the means for attachment additionally comprises adhesive.

4. A display device as in claim 2 which additionally comprises a separately attached tag adapted to be affixed to said tag portion.

5. A display device as in claim 2 wherein the means for attachment additionally comprises fastener means.

* * * * *